US008899092B2

(12) United States Patent
Oguri et al.

(10) Patent No.: US 8,899,092 B2
(45) Date of Patent: Dec. 2, 2014

(54) BENDING APPARATUSES FOR BENDING A SHEET-LIKE MATERIAL

(75) Inventors: Kensuke Oguri, Hamamatsu (JP); Tsuyoshi Kimura, Hamamatsu (JP)

(73) Assignee: Kabushiki Kaisha F.C.C., Shizuoka (JP)

( * ) Notice: Subject to any disclaimer, the term of this patent is extended or adjusted under 35 U.S.C. 154(b) by 29 days.

(21) Appl. No.: 13/163,619

(22) Filed: Jun. 17, 2011

(65) Prior Publication Data

US 2011/0302986 A1 Dec. 15, 2011

Related U.S. Application Data

(63) Continuation of application No. PCT/JP2009/004175, filed on Aug. 27, 2009.

(30) Foreign Application Priority Data

Dec. 19, 2008 (JP) ..... 2008-323251

(51) Int. Cl.
*B21D 13/00* (2006.01)
*B28B 11/00* (2006.01)

(52) U.S. Cl.
CPC ..... *B28B 11/003* (2013.01)
USPC ..... 72/379.6; 72/452.1; 72/370.19

(58) Field of Classification Search
USPC ..... 72/385, 379.6, 452.1, 452.5–452.7, 72/452.4, 384, 370.19
See application file for complete search history.

(56) References Cited

U.S. PATENT DOCUMENTS

| | | | | |
|---|---|---|---|---|
| 3,892,119 | A * | 7/1975 | Miller et al. | 72/385 |
| 4,275,581 | A * | 6/1981 | Miller | 72/385 |
| 6,615,471 | B2 * | 9/2003 | Cape et al. | 29/407.1 |
| 6,772,617 | B1 * | 8/2004 | Allen | 72/302 |
| 7,415,860 | B2 * | 8/2008 | Yamauchi | 72/385 |

FOREIGN PATENT DOCUMENTS

| | | |
|---|---|---|
| JP | 55-51511 | 4/1980 |
| JP | 2003-055028 | 2/2003 |

OTHER PUBLICATIONS

International Search Report for PCT/JP2009/004175 mailed Nov. 24, 2009.

* cited by examiner

*Primary Examiner* — Shelley Self
*Assistant Examiner* — Matthew G Katcoff
(74) *Attorney, Agent, or Firm* — Knobbe Martens Olson & Bear LLP

(57) ABSTRACT

A bending apparatus for corrugating a sheet-like material can comprise a support member, a feed mechanism, a bending member, a hold-down member, and a driving mechanism. The support member can comprise a support surface with corrugations. The feed mechanism can be configured to feed the support member in increments of one pitch of the support member corrugations. The bending member can be configured to reciprocate between a retracted position and an actuated position mating with a corrugation on the support surface so material laying on the support surface is bent along the support member corrugation. The hold-down member can be configured to be reciprocated between a retracted position and an actuated position holding the material against the support surface. The drive mechanism can be configured to sequentially reciprocate the bending member and the hold-down member so the hold-down member presses down the material and the bending member bends the material.

12 Claims, 6 Drawing Sheets

BENDING APPARATUSES FOR BENDING A SHEET-LIKE MATERIAL

CROSS-REFERENCE TO RELATED APPLICATIONS

This application is a continuation of PCT Application No. PCT/JP2009/004175, filed on Aug. 27, 2009, which claims priority to Japanese Application No. 2008-323251, filed on Dec. 19, 2008, the entire contents of each of which are hereby incorporated by reference.

BACKGROUND OF THE DISCLOSURE

1. Field of the Disclosure

The present inventions relate to bending apparatuses for bending sheet-like material to form corrugations on the sheet-like material such that, for example, multiple corrugated sheets can be stacked to form a honeycomb-like structure, such as for a catalyst for an automotive catalytic converter.

2. Description of the Related Art

A honeycomb-like structure for a catalyst carrying precious metals is known to be manufactured by bending sheet-like material made of mainly inorganic material to form corrugations (continuous irregularities) in the sheet-like material and then by stacking the corrugated sheets. One example of such a bending apparatus has a pair of mating gears that have teeth configured to form a desired corrugation on a sheet-like material by passing it between the mated teeth to transfer the tooth shape to the sheet-like material.

Japanese Laid-open Patent Publication No. 2003-055028 discloses a receiving die formed on a support surface. The support surface has a plurality of corrugations (recesses). A sheet-like material is laid on the supporting surface. A plurality of pressing dies correspond to the recesses of the supporting die are pressed down toward the sheet-like material on the supporting die and the recesses of the supporting die to form corrugations.

SUMMARY OF THE INVENTION

An aspect of at least one of the inventions disclosed herein includes the realization that setup of mating-gear type and die type apparatuses for different corrugation shapes (e.g. pitch or cross-sectional configuration) can be simplified, which can reduce manufacturing costs and maintenance costs of the bending apparatus. Also, an improved bending apparatus can hold or restrain movement of the sheet-like material less than the above-described die-type apparatus when forming corrugations on the sheet-like material, thereby decreasing the likelihood that the material becomes damaged during the bending operation.

In the mating-gear-type apparatus, the sheet-like material can be damaged since the mating teeth restrain the sheet-like material more than necessary during the bending process due to mating of teeth at plurality of locations at the same time. Also, in the mating-gear-type apparatus, both gears of a pair must be replaced to change the specification (e.g. pitch and cross-sectional configuration) of the corrugations to be formed on the sheet-like material. Replacement of both gears to make such a change increases the cost of manufacturing the corrugated sheets.

Similarly, in apparatus of Japanese Laid-open Patent Publication No. 2003-055028, the setup operations are complicated since all of the pressing dies must be changed with the receiving die to change the specification (e.g. pitch and cross-sectional configuration) of the corrugations to be formed.

Thus, the provision of plurality a of individually operated pressing dies increases manufacturing costs and maintenance costs of the bending apparatus.

Thus, in accordance with an embodiment, a bending apparatus for corrugating a sheet-like material can comprise a support member, a feed mechanism, a bending member, a hold-down member, and a driving mechanism. The support member can comprise a support surface formed with desired corrugations. The sheet-like material on can be laid on the support surface. The feed mechanism can be configured to feed the support member in increments corresponding to one pitch of the corrugations formed on the support member. The bending member can be configured to be reciprocated between an actuated position, in which the tip of the bending member is positioned in one of the corrugations of the support member such that the bending member and corresponding corrugation are mated with the sheet-like material therebetween, and a retracted position, in which the tip of the bending member is retracted from the corrugations, such that the sheet-like material is bent along the corrugations formed on the support member at the mating of the bending member with the corresponding corrugation of the support surface. The hold-down member can be configured to be reciprocated between an actuated position, in which the tip of the hold-down member is positioned in one of the corrugations of the support member which is adjacent to the corrugation to which the bending member is to be moved such that the hold-down member and the corresponding corrugation are mated, possibly with the sheet-like material therebetween, and a retracted position, in which the tip of the hold-down member is retracted from the corrugations, such that the hold-down member presses or holds down the sheet-like material, which is being bent by the bending member, against the support member. The drive mechanism can be configured to sequentially reciprocate the bending member and the hold-down member so that the hold-down member presses down the sheet-like material and the bending member bends the sheet-like material.

In some embodiments, the bending member and the hold-down member are resiliently supported by elastic members so that loads exceeding predetermined values applied to the bending member and the hold-down member can be absorbed by the elastic members when the tips of the bending member and the hold-down member are moved to their respective actuated positions.

In some embodiments, a separation distance between the bending member and the hold-down member can be selectively varied.

In some embodiments, the separation distance between the bending member and the hold-down member and an incremental feed distance of the feed mechanism can be simultaneously varied in a linked manner.

In embodiments where the bending apparatus comprises a bending member exclusively for bending the sheet-like material and a hold-down member exclusively for pressing or holding down the sheet-like material during the bending process by the bending member, it is possible to avoid over-constraining the sheet-like material during the process of forming corrugations thereon, while facilitating setup of the apparatus when a specification such as a pitch or cross-sectional configuration of the corrugations to be formed on the sheet-like material is changed, which can reduce manufacturing and maintenance costs of the bending apparatus due to the apparatus's simplified structure.

In embodiments where the bending member and the hold-down member are resiliently supported by elastic members so that loads exceeding predetermined values applied to the bending member and the hold-down member can be absorbed by the elastic members when their tips are moved to their respective actuated positions, the bending member and the hold-down member can be used for a variety of specifications (e.g. a dimension of irregularity) without being exchanged.

In embodiments where the separation distance between the bending member and the hold-down member can be selectively varied, the bending member and the hold-down member can be easily adjusted to change a pitch P of the corrugations to be formed on the sheet-like material without exchanging the bending member and the hold-down member.

In embodiments where the separation distance between the bending member and the hold-down member can be selectively varied and an incremental feed distance of the feed mechanism can be simultaneously varied in a linked manner, the feed distance of the feed mechanism can be automatically varied by varying the separation distance between the bending member and the hold-down member and, additionally or alternatively, the separation distance between the bending member and the hold-down member can be automatically varied by varying the feed distance of the feed mechanism. This arrangement can facilitate the bending process and improve its capabilities.

DETAILED DESCRIPTION OF THE PREFERRED EMBODIMENT

Figure 1:
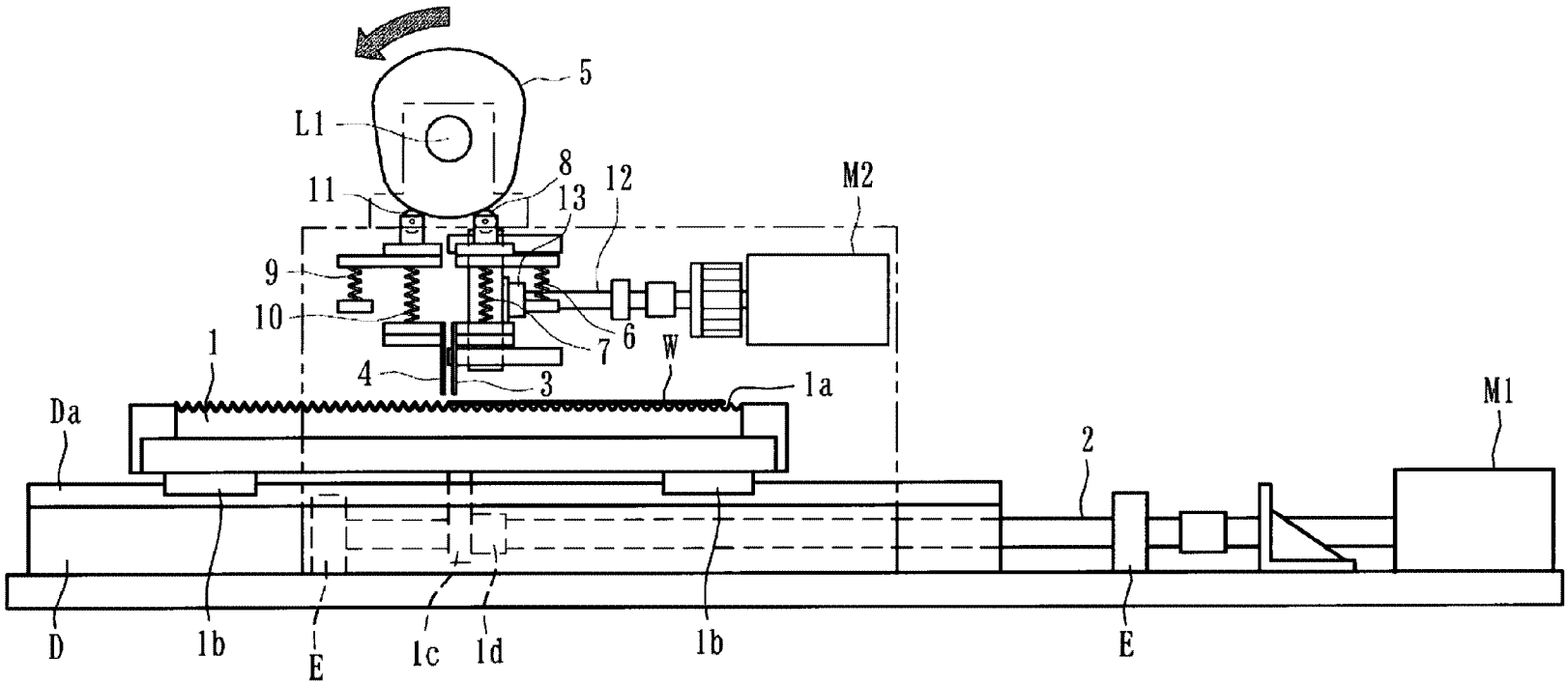
FIG. 1 is a schematic front elevation view illustrating a first embodiment of a bending apparatus for bending a sheet-like material in an initial condition.
Figure 2:
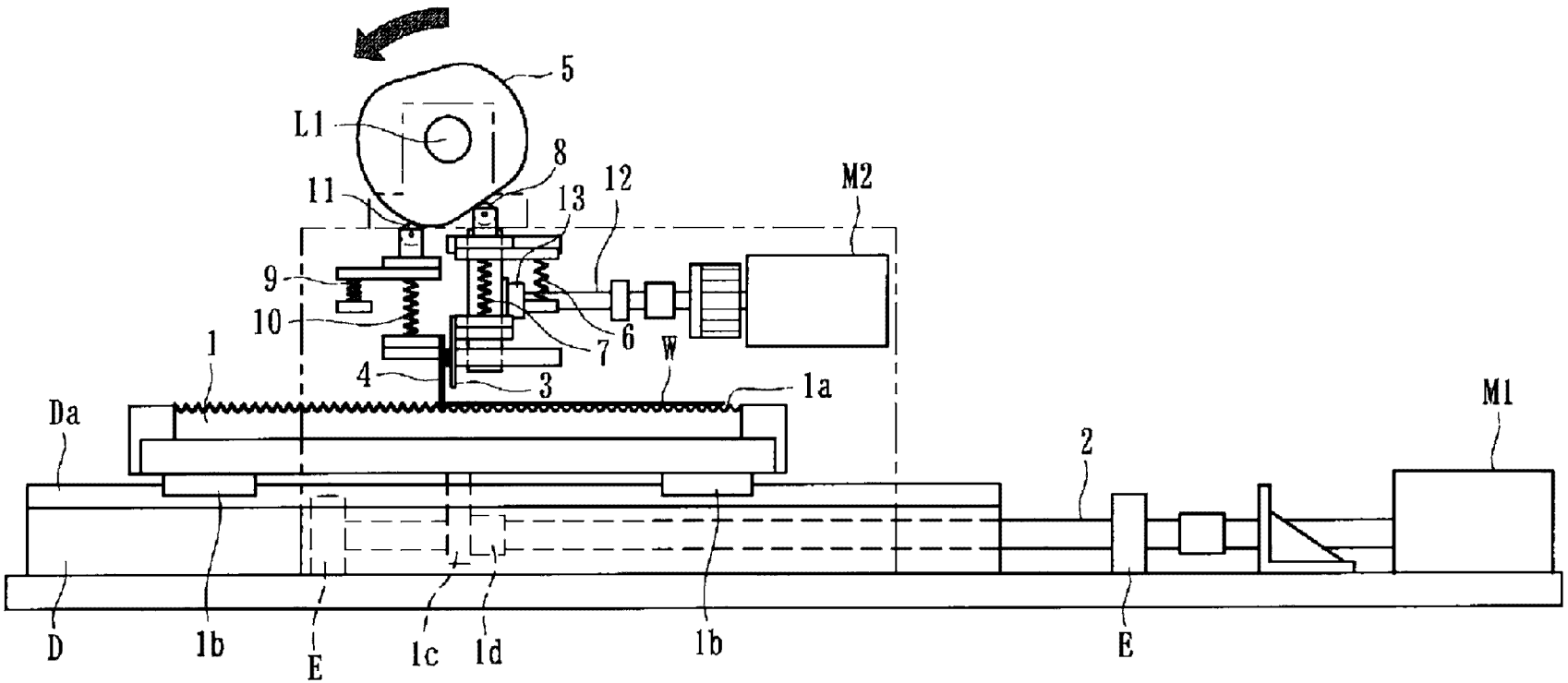
FIG. 2 is a schematic front elevation view illustrating the bending apparatus of FIG. 1 with the hold-down member in an actuated position.

A first embodiment of a bending apparatus for bending a sheet-like material can be configured to corrugate the sheet-like material W such that the corrugated sheets W can be stacked to form a honeycomb-like structure with a plurality of flutes for a catalyst. As illustrated in FIG. 1, the bending apparatus can comprise a support member 1 for laying the sheet-like material W thereon, a feed mechanism, a bending member 3, a hold-down member 4, and a drive mechanism. The feed mechanism can comprise a motor M1 and a ball screw 2. The drive mechanism can comprise a cam member 5.

The sheet-like material W can comprise a sheet, such as a flexible paper-like or foil-like member. In some embodiments, the sheet-like material W can be mainly made of inorganic material. In some embodiments, the sheet-like material W can be produced by a paper- or foil-making method. After having been corrugated by a bending process the sheet-like material W can be used to form a honeycomb-like structure by stacking a plurality of sheets to form a three dimension configuration with a plurality of flutes. The honeycomb-like structure can carry or be formed of precious metal to form a catalyst for use in a vehicle exhaust system. A cross-sectional configuration of corrugation to be formed on the sheet-like material can be of various shapes such as, for example, arcs, triangles, etc.

The support member 1 can comprise a board-like or plate-like member on which the sheet-like material W is placed. The support member can have a support surface 1*a* formed with corrugations of a configuration desired to be formed on the sheet-like material W. The support member 1 can be formed with a guide 1*b* on its lower surface which can be configured to be guided along a rail Da mounted on a base D. Thus, the support member 1 can be slid along the rail Da.

The ball screw 2 can be rotatably supported at its ends by support members E. The ball screw can be connected to an output shaft of the motor M1 so as to be rotated at a selected timing. The support member 1 can have an arm 1*c* extending downward with a threaded portion 1*d* that is configured to mate with threading formed on the ball screw 2. In this way, the support member 1 can be fed. The support member can be fed in increments corresponding to a single pitch P of the corrugations (see FIG. 4) formed on the support member 1 by driving the motor M1 at selected timing and time duration.

Figure 4:
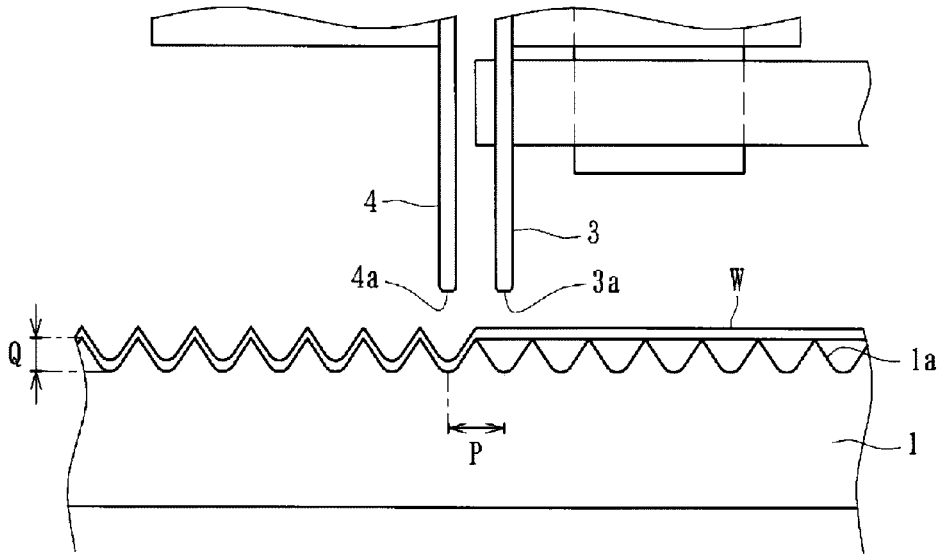
FIG. 4 is an enlarged partial schematic view illustrating the hold-down member and the bending member of the bending apparatus of FIG. 1 in the initial condition.
Figure 5:
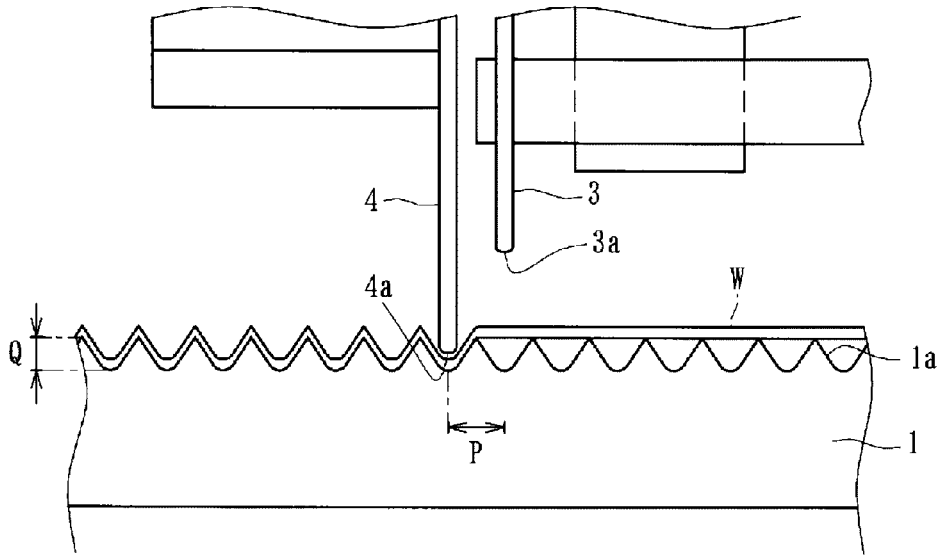
FIG. 5 is an enlarged partial schematic view illustrating the hold-down member and the bending member of the bending apparatus of FIG. 1 with the hold-down member in its actuated position.
Figure 6:
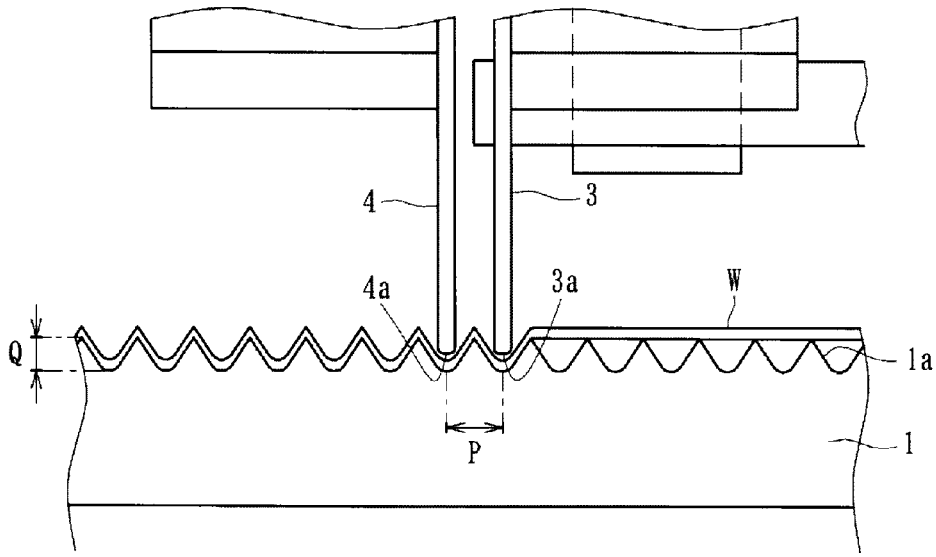
FIG. 6 is a schematic front elevation view illustrating the bending apparatus of FIG. 1 with the hold-down member in its actuated position and the bending member in its actuated position.

The bending member 3 can comprise a board-like or plate-like member configured to be reciprocated (moved upward and downward) between an actuated position (see FIGS. 3 and 6), in which a tip 3*a* of the bending member 3 is positioned in one of the corrugations of the support member 1 such that the bending member and corresponding corrugation are mated with the sheet-like material therebetween, and a retracted or separated position (see FIGS. 1, 2 and FIGS. 4, 5), in which the tip 3*a* of the bending member 3 is retracted or separated from the corrugations, so as to bend the sheet-like material W along the corrugations formed on the support member 1 at the actuated position. For example, the sheet-like member W positioned between the tip 3*a* of the bending member 3 and the corrugation of the support member 1 can be bent by the tip 3*a* when the bending member 3 is driven from the retracted position to the actuated position to have a bent configuration that is the same as or similar to that formed on the support member 1. As illustrated in FIGS. 4-6, the tips 3*a*, and 4*a* can have a configuration which differs from the corrugations formed on the support member and need not fill the corresponding corrugation.

The hold-down member 4 can be configured to be reciprocated between an actuated position (see FIGS. 2, 3 and FIGS. 5, 6), in which a tip 4*a* of the hold-down member 4 is positioned in one of the corrugations of the support member which is adjacent to the corrugation into which the bending member is to be moved such that the hold-down member and the corresponding corrugation are mated, possibly with the sheet-like material therebetween, and a retracted separated position (see FIGS. 1 and 4), in which the tip 4*a* of the hold-down member 4 is retracted or separated from the corrugations, so as to press down the sheet-like material W being bent by the bending member 3 against the support member 1. For example, the hold-down member 4 can be located adjacent to the bending member 3 so that the tip 4*a* of the hold-down member 4 is separated from the tip 3*a* of the bending member 3 by one pitch P of the corrugation of the sheet-like material W.

The bending member 3 and the hold-down member 4 are respectively connected to cam followers 8, 11 via elastic members 7, 10. The elastic members 7, 10 can comprise coil springs. The bending member 3 and the hold-down member 4 can be moved downward to their respective actuated positions when the cam followers 8, 11 are moved downward by a cam member 5. The bending member 3 and the hold-down member 4 can be connected to return springs 6, 9. The cam member 5 can be rotated around a shaft L1 by a drive mechanism such as a motor (not illustrated). The cam member can have a desired cam profile therearound to drive the cam followers 8, 11.

The bending member 3 and the hold-down member 4 can be sequentially reciprocated at a selected timing by cam followers 8, 11 driven by rotation of the cam member 5 and thus the bending process can be performed by the bending member 3 with the sheet-like material W being pressed or held down by the hold-down member 4. The bending process can be continuously repeated by the bending member 3 with a bent portion of the sheet-like material W being pressed down by the hold-down member 4.

If the cam member 5 is further rotated after completion of the bending process by the bending member 3, the cam followers 8, 11 can follow the cam profile of the cam member 5 under urging forces of the return springs 6, 9. Thus, the bending member 3 and the hold-down member 4 can be sequentially moved upward and returned to their initial positions (retracted positions or separated positions). The next bending process can be performed by the bending member 3 with the sheet-like material W being pressed or held down by the hold-down member 4 by driving the motor M1 and feeding the support member 1 by one pitch P of the corrugations formed on the support member 1. Desired corrugations can be formed on the sheet-like material W by repeating the process, which can be performed continuously.

The bending member 3 and the hold-down member 4 are resiliently supported by elastic members 7, 10. The elastic members 7, 10 can be constructed with coil springs so that loads exceeding predetermined values applied to the bending member 3 and the hold-down member 4 can be absorbed by the elastic members 7, 10 when the tips 3*a*, 4*a* of the bending member 3 and the hold-down member 4 are displaced from their respective actuated positions. For example, although a load exceeding a predetermined value would be applied to the bending member 3 and/or the hold-down member 4 if the bottom position of the corrugations is higher than a set amount of downward movement of the bending member 3 and/or the hold-down member 4 when they are moved downward and mated to the corrugations, such a load can be received and absorbed by compression of the elastic members 7, 10.

Since loads exceeding a predetermined value can be absorbed by the elastic members 7, 10, the bending member 3 and the hold-down member 4 can be used for a variety of corrugation specifications (e.g. a dimension of irregularity Q, see FIG. 4) without being exchanged.

In addition, a distance of separation between the bending member 3 and the hold-down member 4 can be selectively varied by a motor M2 and a ball screw 12. For example, the bending member 3 can be connected to a threaded portion 13 mating with a ball screw 12. The bending member 3 can be moved closer to or separated from the hold-down member 4 (moved toward a left or a right direction in FIG. 1) by driving the motor M2.

Since the separation distance between the bending member 3 and the hold-down member 4 can be selectively varied, the separation distance between the bending member and the hold-down member can be easily adjusted by driving the motor M2 to a change of the pitch P of the corrugations to be formed on the sheet-like material without exchanging the bending member 3 and the hold-down member 4.

The feed amount (e.g. an incremental feed distance) of the feed mechanism (e.g. via the ball screw 2) can be varied (corresponding to the pitch P of corrugations after variation) in a linked manner (i.e. automatically related) to change the separation distance between the bending member 3 and the hold-down member 4. Accordingly, the feed distance of the feed mechanism (e.g. the motor M1 and the ball screw 2) can be automatically varied by varying the separation distance between the bending member 3 and the hold-down member 4. Such automatic variation can facilitate the bending process and improve its capabilities. Although the feed distance of the feed mechanism can be automatically varied by varying the separation distance between the bending member and the hold-down member, the reverse is also possible. The separation distance between the bending member and the hold-down member can be varied by varying the feed distance of the feed mechanism, which can similarly facilitate the bending process and improve its capabilities.

The apparatus for bending a sheet-like material of the first embodiment can be operated as follows. The tip 4*a* of the hold-down member 4 can be moved into one corrugation of the support member 1 as illustrated FIGS. 2 and 5 by rotating the cam member 5 around the shaft L1 to move the hold-down member 4 downward. At the start of operation, the tip 4*a* of the hold-down member 4 can engage the support surface 1*a* of the support member 1, for example if no bend has yet been formed on the sheet-like material W. However, in subsequent instances, the tip 4*a* can press down on the portion where bending process has been performed by the bending member 3.

Figure 3:
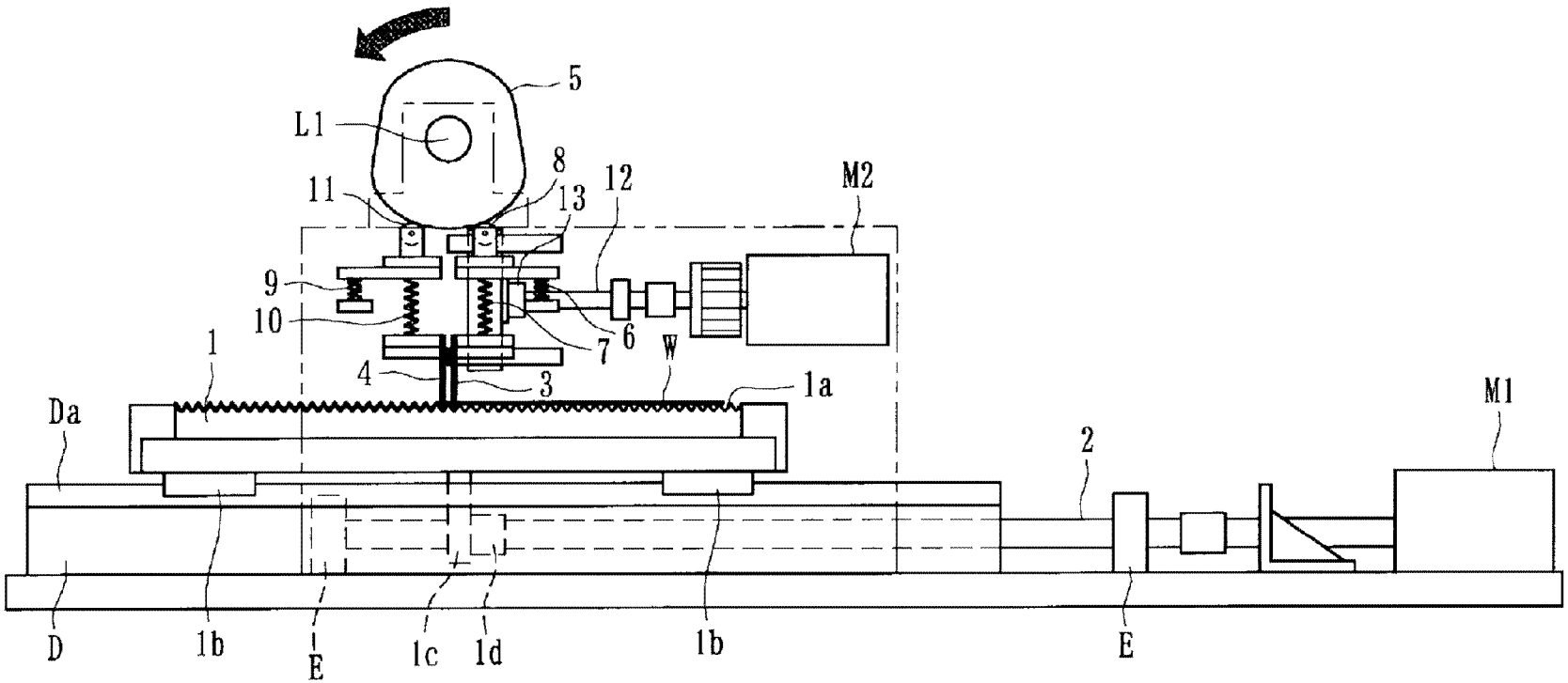
FIG. 3 is a schematic front elevation view illustrating the bending apparatus of FIG. 1 with the hold-down member in its actuated position and the bending member in an actuated position.

Then the sheet-like material W can be bent as illustrated in FIGS. 3 and 6 by continuously rotating the cam member 5 and moving the bending member 3 downward to cause its tip 3*a* to be moved or pressed into the corrugation of the support member 1, for example such that bending member and corresponding corrugation are mated with the sheet-like material therebetween. Since the hold-down member 4 can be kept in the actuated position as illustrated in FIGS. 3 and 6 during the bending operation, the bending operation can be carried out smoothly and exactly with the sheet-like material W being pressed or held down by the hold-down member 4.

The hold-down member 4 and the bending member 3 can be sequentially returned to their retracted positions (initial positions) by continuing rotation of the cam member 5 after completion of the bending operation. The next bending operation can be continuously started by driving the motor M1 and feeding the support member 1 by one pitch P of the corrugations formed on the support member 1 and by continuously rotating the cam member 5 to move the hold-down member 4 and the bending member 3 downward as previously described. The desired corrugations can be formed on the sheet-like material W by repeating the process described above by the number of times desired or necessary.

Since the bending apparatus can comprise a bending member exclusively for bending the sheet-like material and a hold-down member exclusively for pressing or holding down the sheet-like material during the bending process by the bending member, it is possible to avoid over-constraining the sheet-like material during the process of forming corrugations thereon, while facilitating setup of the apparatus when a specification such as a pitch or cross-sectional configuration of the corrugations to be formed on the sheet-like material is changed, which can reduce manufacturing and maintenance costs of the bending apparatus due to the apparatus's simplified structure.

Figure 7:
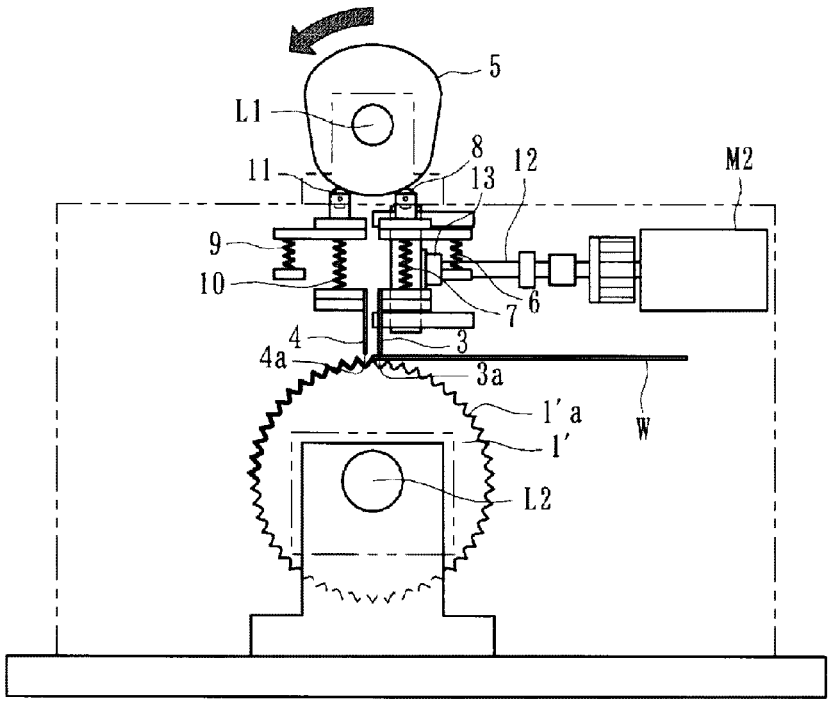
FIG. 7 is a schematic front elevation view illustrating a second embodiment of a bending apparatus for bending a sheet-like material in an initial condition.
Figure 8:
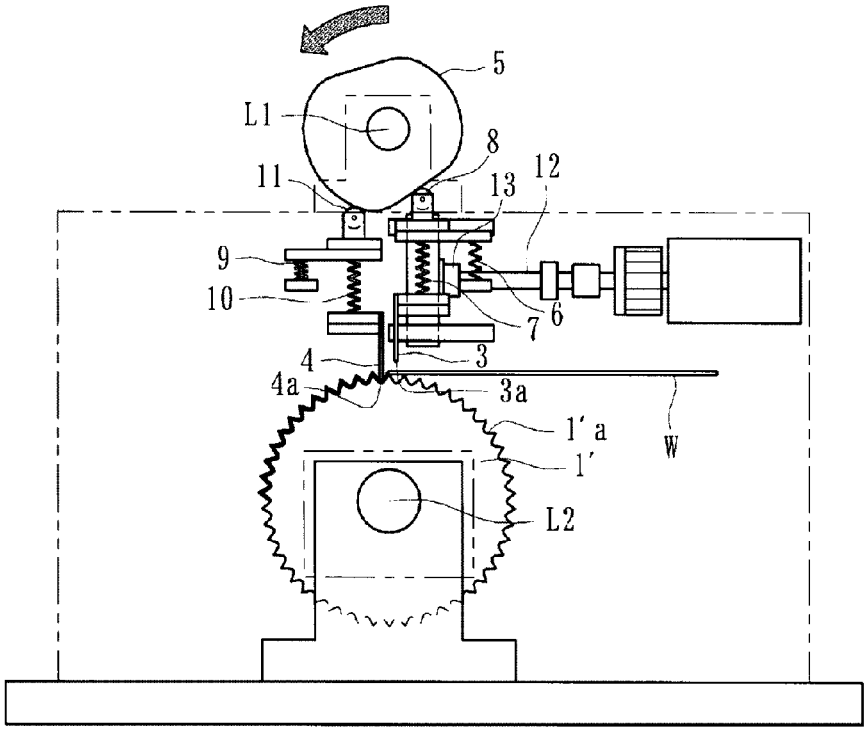
FIG. 8 is a schematic front elevation view illustrating the bending apparatus of FIG. 7 with the hold-down member in an actuated position.
Figure 9:
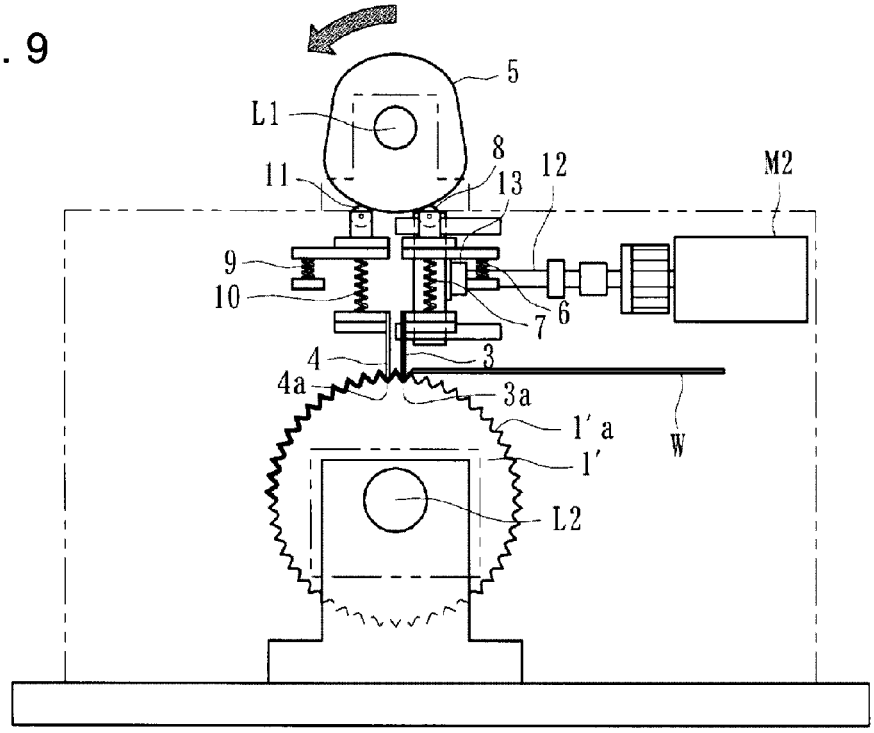
FIG. 9 is a schematic front elevation view illustrating the bending apparatus of FIG. 7 with the hold-down member in its actuated position and the bending member in its actuated position.

A second embodiment of a bending apparatus for bending a sheet-like material is illustrated in FIGS. 7-9. Similar to the first embodiment, the bending apparatus of the second embodiment can be configured to corrugate the sheet-like material W such that the corrugated sheets W can be stacked to form a honeycomb-like structure with a plurality of flutes for a catalyst. As illustrated in FIG. 7, the bending apparatus of the second embodiment can comprise a support member 1', a bending member 3, a hold-down member 4, and a drive mechanism. The drive mechanism can comprise a cam member 5. Reference numerals which are the same as those used in connection with the first embodiment are used in connection with this second embodiment to designate components that are the same as or similar to those of the first embodiment and, therefore, a detailed description of those components is not repeated in the following description of the second embodiment.

The support member 1' can comprise a gear-like member on which the sheet-like material W is placed and on the circumference 1'*a* of which are formed corrugations which are desired to be formed on the sheet-like material W. Similar to the first embodiment, the support member 1' can be rotated around a shaft L2 by a feed mechanism, which can comprise a motor etc. (not shown). The support member 1' can be fed (rotated) in increments corresponding to a single pitch P of the corrugations formed on the support member 1'.

The bending member 3 and the hold-down member 4 can be sequentially reciprocated at a selected timing by cam followers 8, 11 driven by rotation of the cam member 5 and thus the bending process can be performed by the bending member 3 with the sheet-like material W being pressed or held down by the hold-down member 4. The bending process can be continuously performed by the bending member 3 with a bent portion of the sheet-like material W being pressed down by the hold-down member 4.

If the cam member 5 is further rotated after completion of the bending process by the bending member 3, the cam followers 8, 11 can follow the cam profile of the cam member 5 under urging forces of the return springs 6, 9. Thus, the bending member 3 and the hold-down member 4 can be sequentially moved upward and returned to their initial positions (retracted positions or separated positions). The next bending process can be performed by the bending member 3 with the sheet-like material W being pressed or held down by the hold-down member 4 by driving the motor (not illustrated) and feeding the support member 1' by one pitch P of the corrugations formed on the support member 1'. Desired corrugations can be formed on the sheet-like material W by repeating the process, which can be performed continuously.

The apparatus for bending a sheet-like material of the second embodiment can be operated as follows. The tip 4*a* of the hold-down member 4 can be moved into one corrugation of the support member 1' as illustrated FIG. 8 by rotating the cam member 5 around the shaft L1 to move the hold-down member 4 downward. At the start of operation, the tip 4*a* of the hold-down member 4 can engage the support surface 1'*a* of the support member 1', for example if no bend has yet been formed on the sheet-like material W. However, in subsequent instances, the tip 4*a* can press down on the portion where bending process has been performed by the bending member 3.

Then, the sheet-like material W can be bent as illustrated in FIG. 9 by continuously rotating the cam member 5 and moving the bending member 3 downward to cause its tip 3*a* to be moved or pressed into the corrugation of the support member 1', for example such that bending member and corresponding corrugation are mated with the sheet-like material therebetween. Since the hold-down member 4 can be kept in the actuated position as illustrated in FIG. 9 during the bending operation, the bending operation can be carried out smoothly and exactly with the sheet-like material W being pressed or held down by the hold-down member 4.

The hold-down member 4 and the bending member 3 can be sequentially returned to their retracted positions (initial positions) by continuing rotation of the cam member 5 after completion of the bending operation. The next bending operation can be continuously started by driving the motor (not illustrated) and feeding the support member 1' by one pitch P of the corrugations formed on the support member 1' and by continuously rotating the cam member 5 to move the hold-down member 4 and the bending member 3 downward as previously described. The desired corrugations can be formed on the sheet-like material W by repeating the process described above by the number of times desired or necessary.

Similar to the first embodiment, since the bending apparatus can comprise a bending member exclusively for bending the sheet-like material and a hold-down member exclusively for pressing or holding down the sheet-like material during the bending process by the bending member, it is possible to avoid over-constraining the sheet-like material during the process of forming corrugations thereon, while facilitating setup of the apparatus when a specification such as a pitch or cross-sectional configuration of the corrugations to be formed on the sheet-like material is changed, which can reduce manufacturing and maintenance costs of the bending apparatus due to the apparatus's simplified structure.

As illustrated by the first and second embodiments, since the separation distance between the bending member 3 and the hold-down member 4 can be selectively varied and an incremental feed distance of the feed mechanism can be simultaneously varied in a linked manner, the bending process is facilitated and corrugations of different pitches can easily be formed on one piece of sheet-like material W.

Although the present inventions have been described with reference to certain embodiments, it is not limited to the illustrated and described embodiments. For example, the cam member 5 and the support member 1, 1' can be manually driven. When the cam member 5 is manually driven, the apparatus can comprise an alarm to signal a timing of operation of the bending member 3 to perform the bending operation.

The bending member 3 and the hold-down member 4 can be driven by drive mechanisms other than the cam member 5 for reciprocating them at a predetermined timing. For example, reciprocation (or upward and downward movement) can be performed by hydraulic cylinders etc. The motor M2 described above for varying the separation distance between the bending member 3 and the hold-down member 4 can be replaced by other drive mechanisms such as hydraulic cylinders or a manually operated mechanisms.

Although coil springs are used in the illustrated embodiments for resiliently supporting the bending member 3 and the hold-down member 4, other elastic members such as leaf springs, torsion springs or soft plastic springs can be used to absorb excessive load on the tips 3*a*, 4*a* of the bending member 3 and the hold-down member 4 when they are moved to their respective actuated positions. It is also possible to resiliently support either one of the bending member 3 and the hold-down member 4 alone.

Certain aspects and features of the present disclosure can be applied to apparatuses for bending sheet-like material even though they may have different configurations in external appearance, structural parts, or have additional functions.

What is claimed is:

1. A bending apparatus for corrugating material, comprising:

a support member having a support surface configured to support the material, the support member formed with corrugations;

a feed mechanism configured to feed the support member in feed increments corresponding to individual pitches of the corrugations formed on the support member;

a bending member configured to be reciprocated between an actuated position and a retracted position to bend the material along the corrugations formed on the support member, a tip of the bending member being moved into one of the corrugations of the support member in the actuated position and being retracted from the corrugations in the retracted position;

a hold-down member configured to be reciprocated between an actuated position and a retracted position independent from the reciprocation of the bending member, a tip of the hold-down member being moved into one of the corrugations of the support member which is separate from the corrugation which corresponds with the actuated position of the bending member so as to press down the material against the support member in the actuated position of the hold-down member and being retracted from the corrugations in the retracted position; and a drive mechanism configured to sequentially and independently reciprocate the bending member and the hold-down member so that the hold-down member presses down the material and the bending member bends the material; and an actuator connected to the bending member and configured to move the bending member toward or away from the hold-down member in a lateral direction;

wherein the corrugations of the support member support a bent portion of the material as the material is fed in feed increments downstream from the bending member.

2. The bending apparatus of claim 1, wherein the bending member and the hold-down member are resiliently supported by elastic members so that loads exceeding predetermined values applied to the bending member and the hold-down member can be absorbed by the elastic members when their tips are moved to their respective actuated positions.

3. The bending apparatus of claim 1, wherein the lateral separation distance between the bending member and the hold-down member and the feed increments of the feed mechanism are linked such that the separation distance and the feed increment are variable simultaneously.

4. The bending apparatus of claim 1, wherein the support surface of the support member is formed with corrugations in a plane transverse to a direction of motion between an actuated position and a retracted position of at least one of the bending member and the hold-down member.

5. The bending apparatus of claim 1, wherein the drive mechanism is configured to, before moving the bending member to the actuated position, first move the hold-down member from the retracted position to the actuated position so as to press down the sheet-like material and such that the tip of the hold-down member is moved into one of the corrugations of the support member.

6. The bending apparatus of claim 5, wherein the drive mechanism is also configured to, after moving the hold-down member to the actuated position, next move the bending apparatus from the retracted position to the actuated position such that the bending member bends the sheet-like material and the tip of the bending member is moved into one of the corrugations of the support member.

7. The bending apparatus of claim 6, wherein the drive mechanism is further configured to, after moving the bending apparatus to the actuated position, next move the hold-down member from the actuated position to the retracted position.

8. The bending apparatus of claim 7, wherein the drive mechanism is further configured to, after moving the hold-down member to the retracted position, next move the bending apparatus from the actuated position to the retracted position.

9. A bending apparatus for bending material, the bending apparatus comprising:

a support member having a support surface, the support surface formed with a plurality of corrugations;

a first motor operably connected to the support member; a cam drive;

a first cam follower in contact with the cam drive and selectively driven toward the support member by the cam drive;

a second cam follower in contact with the cam drive and selectively driven separately from the first cam follower toward the support member by the cam drive;

a bending member connected to the first cam follower via a first elastic member, wherein the first cam follower drives the bending member toward the support member when the cam drive drives the first cam follower toward the support member;

a first return spring connected to the first cam follower, wherein the first return spring biases the first cam follower away from the support member;

a hold-down member connected to the second cam follower via a second elastic member and spaced laterally from the bending member, wherein the second cam follower drives the hold-down member toward the support member when the cam drive drives the second cam follower toward the support member;

a second return spring connected to the second cam follower, wherein the second return spring biases the second cam follower away from the support member;

a second motor operably connected to the bending member, wherein the second motor is configured to move the bending member toward or away from the hold-down member to change a pitch of the lateral spacing between the hold-down member and the bending member.

10. The bending apparatus of claim 9, wherein the first elastic member absorbs loads applied to the bending member which exceed a first predetermined value, and wherein the second elastic member absorbs loads applied to the hold-down member which exceed a second predetermined value.

11. The bending apparatus of claim 1, wherein the drive mechanism comprises a cam drive, wherein the bending member is connected to a first cam follower which contacts the cam drive, and wherein the hold-down member is connected to a second cam follower which contacts the cam drive.

12. The bending apparatus of claim 1, wherein the actuator is a motor.

* * * * *